US006106254A

United States Patent [19]

Hirooka et al.

[11] Patent Number: 6,106,254

[45] Date of Patent: Aug. 22, 2000

[54] CLOSED-TYPE SCROLL COMPRESSOR

[75] Inventors: Katsumi Hirooka; Hisao Mizuno, both of Nishi-kasugai-gun, Japan

[73] Assignee: Mitsubishi Heavy Industries, Ltd., Tokyo, Japan

[21] Appl. No.: 09/121,941

[22] Filed: Jul. 24, 1998

[30] Foreign Application Priority Data

Dec. 18, 1997 [JP] Japan ..... 9-363835

[51] Int. Cl.[7] ..... F04C 18/00

[52] U.S. Cl. ..... 418/55.6; 418/55.1; 417/410.5; 184/6.18

[58] Field of Search ..... 418/55.6, 55.1; 417/410.5; 184/6.18

[56] References Cited

U.S. PATENT DOCUMENTS

| | | | |
|---|---|---|---|
| 4,065,279 | 12/1977 | McCulough | 418/55.1 |
| 4,343,599 | 8/1982 | Kabe | 418/55.1 |
| 4,564,339 | 1/1986 | Nakamura et al. | 418/55.1 |
| 4,621,993 | 11/1986 | Nakamura et al. | 418/55.1 |
| 4,824,344 | 4/1989 | Kimura et al. | 418/55.1 |
| 5,304,045 | 4/1994 | Hoshino et al. . | |
| 5,533,875 | 7/1996 | Crum et al. . | |
| 5,810,573 | 9/1998 | Mitsunaga et al. | 418/55.6 |

FOREIGN PATENT DOCUMENTS

| | | | |
|---|---|---|---|
| 0 798 465 | 10/1997 | European Pat. Off. . | |
| 0117191 | 5/1988 | Japan | 418/55.6 |
| 4-370384 | 12/1992 | Japan . | |
| 5-010284 | 1/1993 | Japan . | |
| 5-231355 | 9/1993 | Japan . | |
| 08014181 | 1/1996 | Japan . | |
| 9-126177 | 5/1997 | Japan . | |
| 09209957 | 8/1997 | Japan . | |

*Primary Examiner*—Thomas Denion
*Assistant Examiner*—Thai-Ba Trieu
*Attorney, Agent, or Firm*—Oblon, Spivak, McClelland, Maier & Neustadt, P.C.

[57] ABSTRACT

A closed-type scroll compressor comprising a closed housing (8) formed with a low-pressure chamber (45) and a high-pressure chamber (44), a scroll-type compression mechanism (C) having a swirling scroll (1) and a fixed scroll (2) and disposed in said low-pressure chamber (45), a frame (6) for fixing said fixed scroll (2) provided with a first oil drainage passage (62), a motor (M) for driving said scroll-type compression mechanism (C) made up of a stator (Mb) provided with a second oil drainage passage (84) and a rotor (Ma), a shaft (5) provided in a second oil drainage passage (52) for transmitting a driving force of said motor (M) to said scroll-type compression mechanism (C), characterized by providing a connection oil drainage passage (93) that is formed by a trough (90) and an inner circumferential surface of said closed housing (8) and whose inlet end is located near an outlet of said first oil drainage passage (62) and whose outlet end is located near an inlet of said second oil drainage passage (84).

4 Claims, 4 Drawing Sheets

CLOSED-TYPE SCROLL COMPRESSOR

BACKGROUND OF THE INVENTION

1. Field of the Invention

The present invention relates to a closed-type scroll compressor. The present specification is based on Japanese Patent Application No. Hei 9-363835, the contents of which are herein incorporated in part by reference.

2. Background Art

One example of a conventional closed-type scroll compressor is shown in FIG. 5.

The inside of a closed-type housing 8 is partitioned into a high-pressure chamber 44 and a low-pressure chamber 45 by a discharge cover 31.

A scroll-type compression mechanism C is arranged in the upper part of the low-pressure chamber 45 and a motor M is arranged below it for driving it through a rotating shaft 5.

An oil reservoir 81 is formed in the bottom part of the low-pressure chamber 45.

The motor M is made up of a rotor Ma and a stator Mb, the rotor Ma is fixed to the rotating shaft 5, and the stator Mb is fixed by pressing into the closed housing 8.

The scroll-type compression mechanism C is provided with a fixed scroll 1, a swirling scroll 2, a frame 6, a rotation stopping mechanism 3, a drive bush 54, a swirling bearing 73, etc.

The fixed scroll 1 is provided with an end plate 11 and a spiral wrap 12 vertically projecting therein, and a discharge port 13 is formed in the center part of the end plate 11.

The swirling scroll 2 is provided with an end plate 21 and a spiral wrap 22 vertically projecting therein, and a drive bush 54 is inserted rotatably into a vertical boss 23 at the center of the outer surface of the end plate 21 through the swirling bearing 73.

An eccentric pin 53 projecting from the upper end of the rotating shaft 5 is rotatably inserted in to a hole 55 formed in the drive bush 54.

The fixed scroll 1 and the swirling scroll 2 are meshed with each other eccentrically at a prescribed distance and are shifted by 180° to form a plurality of closed spaces 24.

The frame 6 is fixed to the closed housing 8, and the fixed scroll 1 is fastened to the frame 6 by bolts 32.

The outer surface of the end plate 21 of the swirling scroll 2 is supported slidably on a thrust surface 65 formed on the upper surface of the frame 6, and the thrust surface 65 is formed with a plurality of oil grooves 66.

The rotation stopping mechanism 3 comprising an Oldham ring, etc. that allows the orbital rotational movement of the swirling scroll 2 but does not allow the swirling scroll 2 to spin around its own axis is disposed between the peripheral edge of the outer surface of the end plate 21 of the swirling scroll 2 and the frame 6.

A cylindrical flange 16 is projected upward at the center of the outer surface of the end plate 11 of the fixed scroll 1, and the outer circumferential surface of the flange 16 and the inner circumferential surface of the cylindrical flange 38 which is projected downward toward the undersurface of the discharge cover 31 are sealed with an O-ring 39 to form a discharge cavity 42.

The central part of the discharge cover 31 is formed with a discharge hole 46 in communication with the discharge cavity 42, and the discharge hole 46 is opened and closed by a discharge valve 47.

One end of the discharge valve 47 and one end of a valve holder 48 are fixed to the outer surface of the discharge cover 31 by a bolt 49.

The upper end part of the rotating shaft 5 is supported by an upper bearing 71 provided on the frame 6 and the lower end part is supported by a lower bearing 72 provided on a stay 18.

By driving the motor M, the swirling scroll 2 is driven through the rotating shaft 5, the eccentric pin 53, the drive bush 54, the swirling bearing 73 and the boss 23, and the swirling scroll 2 is rotated in orbit while being prevented from rotating around its own axis by the rotation stopping mechanism 3.

Then, a gas is introduced into the low-pressure chamber 45 through a suction pipe 82, is passed through a gas suction passage 67 formed in the frame 6, and is sucked through a gas suction passage 68 formed in the fixed scroll 1 and suction ports 15 into the closed spaces 24.

As the volumes of the closed spaces 24 are decreased by the orbital motion of the swirling scroll 2, the gas is compressed and then the gas reaches the central part and enters the discharge cavity 42 from the discharge port 13.

Then, the gas passes the discharge hole 46, pushes open the discharge valve 47 to go into the high-pressure chamber 44, and is discharged outside therefrom through a discharge pipe 83.

At the same time, an oil in the oil reservior 81 is pumped up by an oil feeding pump 60 disposed at the lower end part of the rotating shaft 5 and is passed through an oil feeding passage 52 formed in the rotating shaft 5 to lubricate the lower bearing 72 and the upper bearing 71. After the oil discharged from the tip of the oil feeding passage 52 lubricates the drive bush 54 and the swirling shaft 73, the oil passes a recess 61 formed in the central part of the upper surface of the frame 6 and an oil drainage passage 62 and drops through an oil passage 84 formed in the stator Mb of the motor M into the oil reservior 81.

When the above conventional closed-type scroll compressor is operated, the gas sucked through the suction pipe 82 into the low-pressure chamber 45 is stirred by the rotor Ma of the motor M. Accordingly, the oil dropping from the oil drainage passage 62 is blown off by the gas swirling in the low-pressure chamber 45 to go hardly into the oil passage 84 and accompanies this gas, thereby, the oil is sucked by the scroll-type commpression mechanism C.

As a result, since the amount of the oil dropping in to the oil reservior decreases and the amount of the oil raised, that is, the amount of the oil that accompanies the discharge gas and which is discharged from the closed housing 8, is increased, the amount of the oil in the oil reservoir 81 decreases, leading to concern that an accident, such as defective lubrication and seizing due to the defective lubrication, will occur. To counter this, it is conceivable to provide an oil drainage passage in communication with the above recess 61 or the oil drainage passage 62 and separated from the low-pressure chamber 45, but it makes the structure in the closed-type scroll compressor complicated.

SUMMARY OF THE INVENTION

The present invention has been made to solve the above problems and provides a closed-type scroll compressor, comprising a closed housing formed with a low-pressure chamber and a high-pressure chamber, a scroll-type compression mechanism having a fixed scroll and a swirling scroll and disposed in said low-pressure chamber, a frame for fixing said fixed scroll provided with a first oil drainage passage, a motor for driving said scroll-type compression mechanism made up of a stator provided with a second oil drainage passage and a rotor, a shaft for transmitting the driving force of said motor to said scroll-type compression mechanism, and a connection oil drainage passage that is formed by a trough and the inner circumferential surface of said closed housing and whose inlet end is located near the outlet of said first oil drainage passage and whose outlet end is located near the inlet of said second oil drainage passage.

In the closed-type scroll compressor of the present invention, by the provision of the connection oil drainage passage whose inlet end is located near the outlet of said first oil drainage passage and whose outlet end is located near the inlet of said second oil drainage passage, the oil which flows out from the first oil drainage passage is led through the connection oil drainage passage into the second oil drainage passage. Accordingly, the oil is not blown off by the gas stirred up by the rotor of the motor and does not accompany that gas to be sucked into the scroll-type compression mechanism C.

As a result, since decreased in the amount of oil dropping in to the oil reservoir are prevented and the amount of oil which is raised can be decreased, defective lubrication and seizing due to a decrease in the oil reservoir can be prevented.

Further, since the connection oil drainage passage is formed by a trough and the inner circumferential surface of said closed housing, a structure having a trough that is simple and low in cost can be provided without changing the structure of the conventional closed-type scroll compressor.

DETAILED DESCRIPTION OF THE INVENTION

Hereinbelow, preferable embodiments of the present invention are described with reference to the drawings.

First Embodiment

Figure 1:
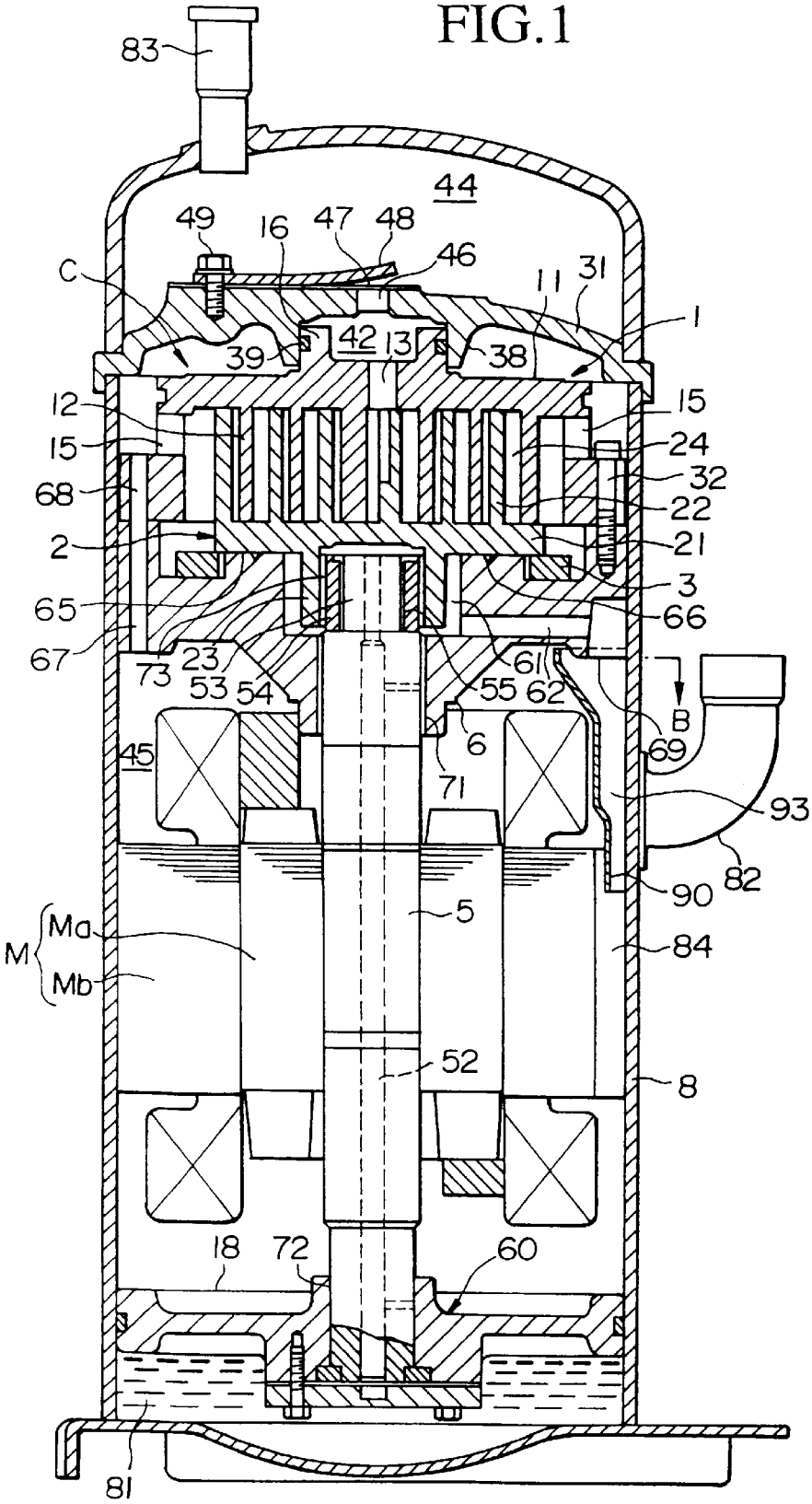
FIG. 1 is a vertical cross section that shows a first embodiment of the present closed-type scroll compressor.
Figure 2:
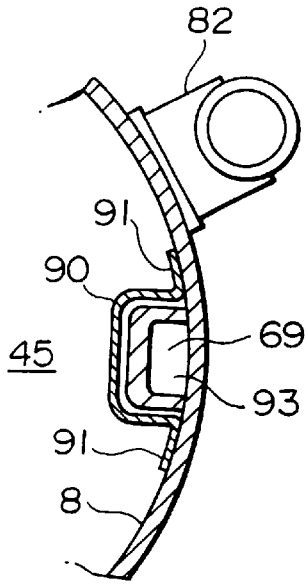
FIG. 2 is a partial transverse section taken along line B—B of FIG. 1.

FIG. 1 is a vertical cross section that shows a first embodiment of the present closed-type scroll compressor and FIG. 2 is a partial transverse section taken along line B—B of FIG. 1.

The inside of a closed-type housing 8 is partitioned into a high-pressure chamber 44 and a low-pressure chamber 45 by a discharge cover 31.

A scroll-type compression mechanism C is disposed in the upper part of the low-pressure chamber 45, and a motor M for driving it through a rotating shaft 5 is disposed in the lower part thereof.

An oil reservoir 81 is formed in the bottom part of the low-pressure chamber 45.

The motor M is made up of a rotor Ma and a stator Mb, the rotor Ma is fixed to a rotating shaft 5, and the stator Mb is fixed by inserting it into the closed housing 8.

The scroll-type compression mechanism C is provided with a fixed scroll 1, a swirling scroll 2, a frame 6, a rotation stopping mechanism 3, a drive bush 54, a swirling bearing 73, etc.

The fixed scroll 1 is provided with an end plate 11 and a spiral wrap 12 vertically projecting therein, and a discharge port 13 is formed in the center part of the end plate 11.

The swirling scroll 2 is provided with an end plate 21 and a spiral wrap 22 vertically projecting therein and a drive bush 54 is inserted rotatably into a vertical boss 23 at the center of the outer surface of the end plate 21 through the swirling bearing 73.

An eccentric pin 53 projecting from the upper end of the rotating shaft 5 is rotatably inserted into a hole 55 formed in the drive bush 54.

The fixed scroll 1 and the swirling scroll 2 are meshed with each other eccentrically at a prescribed distance and are shifted by 180° to form a plurality of closed spaces 24.

The frame 6 is fixed to the closed housing 6, and the fixed scroll 1 is fastened to the frame 6 by bolts 32.

The outer surface of the end plate 21 of the swirling scroll 2 is supported slidably on a thrust surface 65 formed on the upper surface of the frame 6, and the thrust surface 65 is formed with a plurality of oil grooves 66.

The rotation stopping mechanism 3 comprising an Oldham link, etc. that allows the orbital rotational movement of the swirling scroll 2 but does not allow the swirling scroll 2 to spin around its own axis is disposed between the peripheral edge of the outer surface of the end plate 21 of the swirling scroll 2 and the frame 6.

A cylindrical flange 16 is projected upward at the center of the outer surface of the end plate 11 of the fixed scroll 1, and the outer circumferential surface of the flange 16 and the inner circumferential surface of the cylindrical flange 38 projected downward toward the undersurface of the discharge cover 31 are sealed with an O-ring 39 to form a discharge cavity 42.

The center part of the discharge cover 31 is formed with a discharge hole 46 in communication with the discharge cavity 42, and the discharge hole 46 is opened and closed by a discharge valve 47.

One end of the discharge valve 47 and one end of a valve holder 48 are fixed to the outer surface of the discharge cover 31 by a bolt 49.

The upper end part of the rotating shaft 5 is supported by an upper bearing 71 provided on the frame 6 and the lower end part is supported by a lower bearing 72 provided on a stay 18.

Flanges 91 formed on the opposite edges of a guide plate 90 generally in the form of a trough are fixed to the inner surface of the closed housing 8, the upper end of the guide plate 90 covers an outlet end 69 of a first oil drainage passage 62, and the lower end is extended near an inlet of a second oil drainage passage 84 or is extended a little into the inlet of the second oil drainage passage 84.

By driving the motor M, the swirling scroll 2 is driven through the rotating shaft 5, the eccentric pin 53, the drive bush 54, the swirling bearing 73 and the boss 23, and the swirling scroll 2 is rotated in orbit while being prevented from rotating around its own axis by the rotation stopping mechanism 3.

Then, a gas is introduced into the low-pressure chamber 45 through a suction pipe 82, is passed through a gas suction passage 67 formed in the frame 6, and is sucked through a gas suction passage 68 formed in the fixed scroll 1 and suction ports 15 into the closed spaces 24.

As the volumes of the closed spaces 24 are decreased by the orbital motion of the swirling scroll 2, the gas is compressed and then the gas reaches the central part and enters the discharge cavity 42 from the discharge port 13.

Then, the gas passes the discharge hole 46, pushes open the discharge valve 47 to go into the high-pressure chamber 44, and is discharged outside therefrom through a discharge pipe 83.

At the same time, oil in the oil reservior 81 is pumped up by an oil feeding pump 60 disposed at the lower end part of the rotating shaft 5 and is passed through an oil feeding passage 52 formed in the rotating shaft 5 to lubricate the lower bearing 72 and the upper bearing 71. After the oil discharged from the tip of the oil feeding passage 52 lubricates the drive bush 54 and the swirling shaft 73, the oil passes a recess 61 formed in the central part of the upper surface of the frame 6, the first oil drainage passage 62, a connection oil drainage passage 93, and the second oil drainage passage 84 formed in the stator Mb of the motor M successively and drops into the oil reservior 81.

Due to the above constitution, the oil which flows out from the oil drainage passage is not blown off by the gas stirred by the rotor Ma of the motor M and also does not accompany the gas to be sucked into the scroll-type compression mechanism C. Therefore without changing the structure of the conventional apparatus, since the provision of a guide plate in the shape of a trough in a structure that is simple and low in cost can prevent decreased in the amount of oil dropping into the oil reservior and can reduce the amount of oil that is raised, there is such a remarkable effect that defective lubrication and seizing due to a decrease the amount of oil in the oil reservoir can be prevented.

Figure 5:
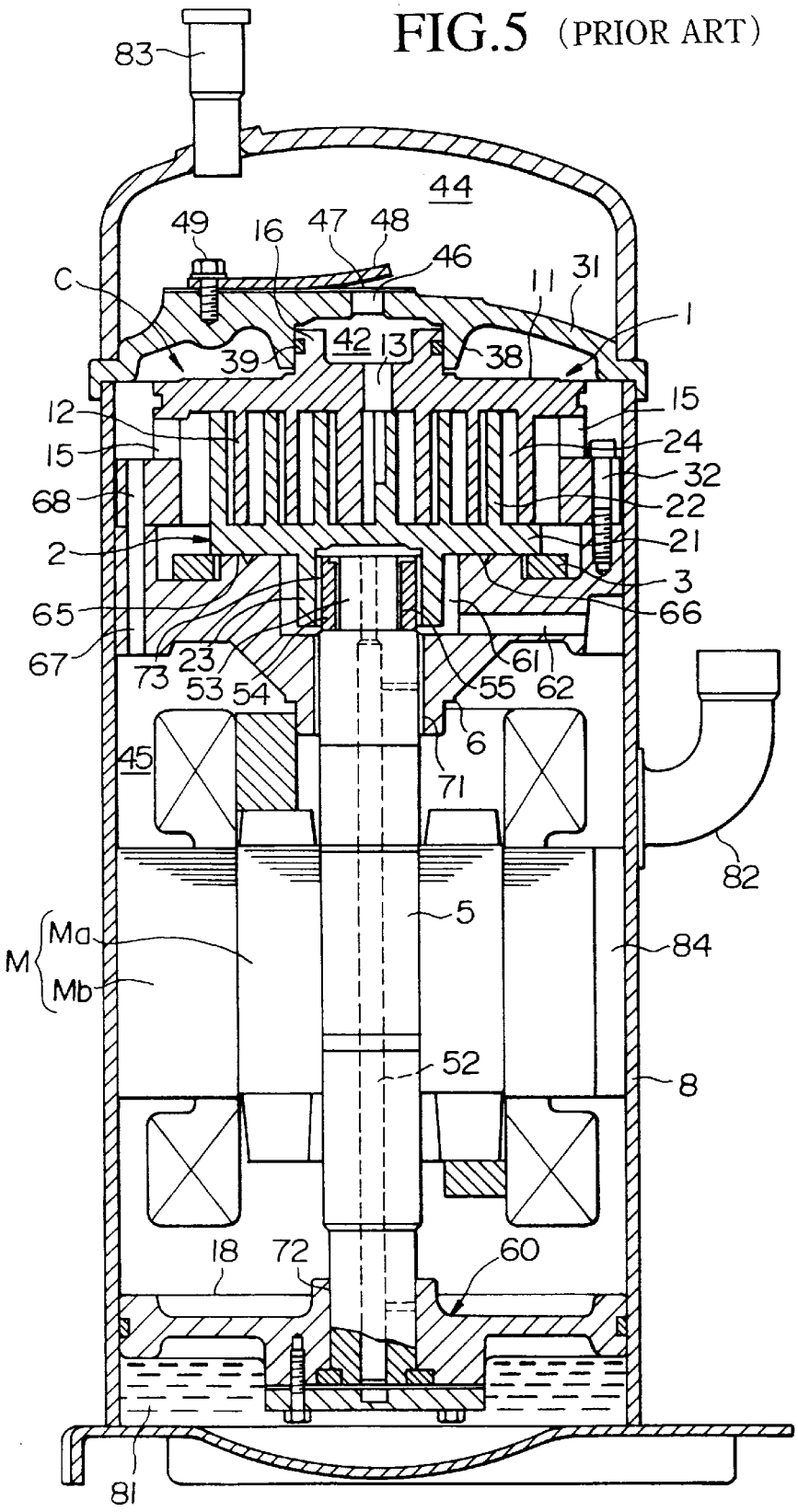
FIG.5 (PRIOR ART)
FIG. 5 is a vertical cross section of a conventional closed-type scroll compressor.

Other structure is the same as that of the conventional compressor shown in FIG. 5 and a description is omitted and corresponding members are labeled with the same symbols.

Second Embodiment

Figure 4:
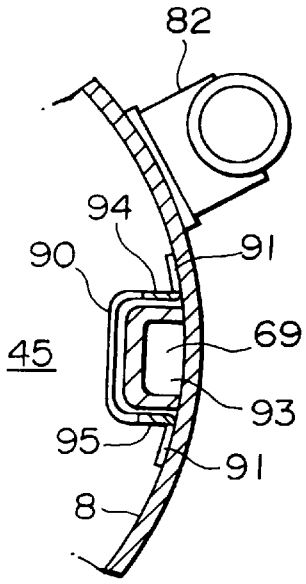
FIG. 4 is a partial transverse section taken along line B—B of FIG. 3.
Figure 3:
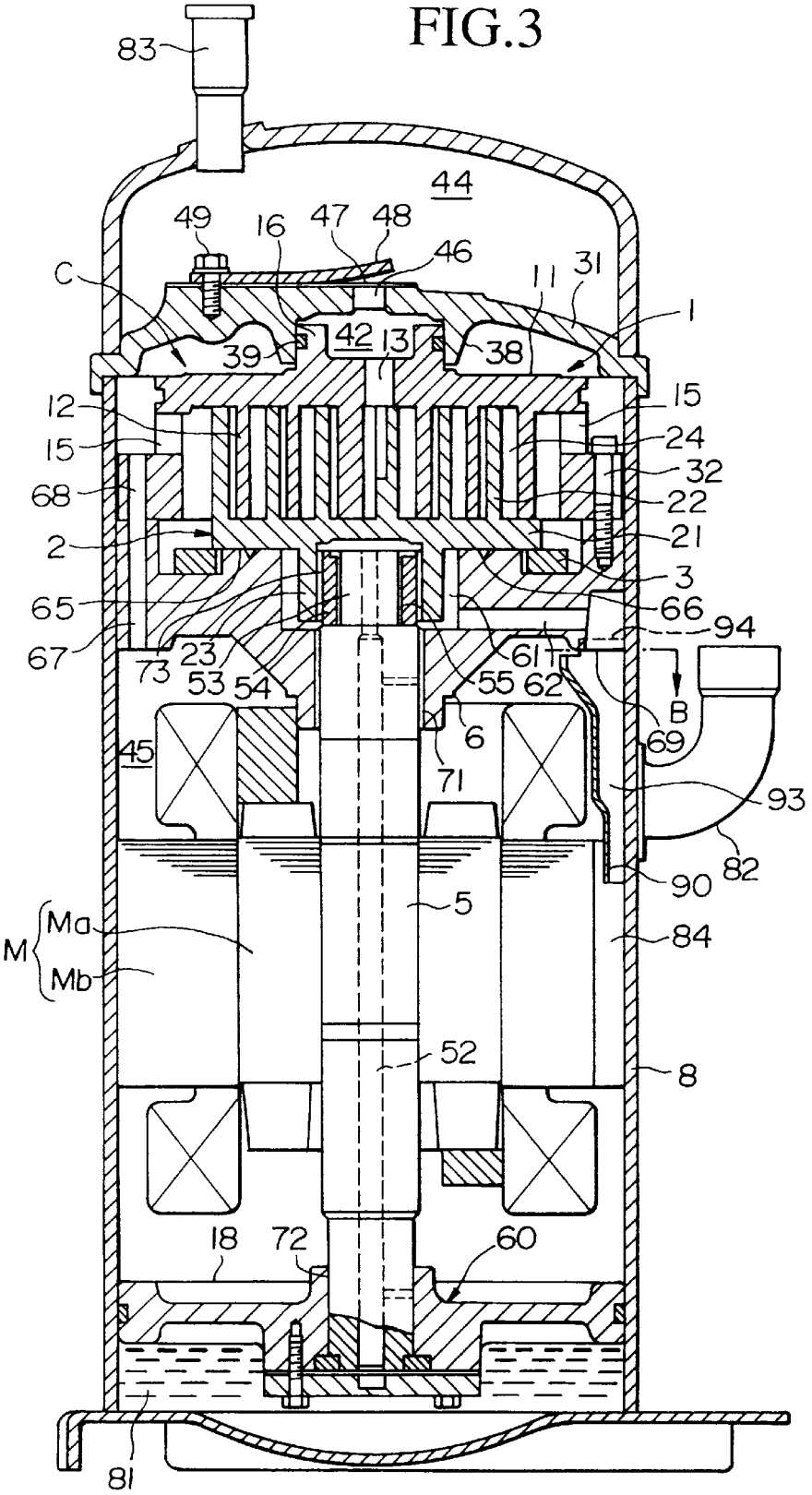
FIG. 3 is a vertical cross section that shows a second embodiment of the present closed-type scroll compressor.

FIG. 3 is a vertical cross section that shows a second embodiment of the present closed-type scroll compressor and FIG. 4 is a partial transverse section taken along line B—B of FIG. 3.

This second embodiment is a mode that is also effective for cases in which for some reason it is impossible to cover an outlet end 69 of an oil drainage passage 62 at the upper end of a guide plate 90 having the shape of a trough as in the first embodiment. That is, two surfaces 94 and 95 which are at right angles with the inner surface of a closed housing 8 are extended to positions where they cover the outlet end 69 of the oil drainage passage 62, so that only the circumferential part of the outlet end of the first oil drainage passage is covered.

Other structure is the same as that of the first embodiment shown in FIG. 1 and a description is omitted and corresponding members are labeled with the same symbols.

According to this embodiment, since the gas stirred by a rotor Ma of a motor M and swirling in a low-pressure chamber 45 is cut off by the two surfaces 94 and 95 and thereby is not blown into the outlet end 69 of the first oil drainage passage 62, the oil which flows out from the outlet end 69 drops into a connection oil drainage passage 93 defined by a guide plate 90 and the inner surface of a closed housing 8. Therefore, the oil which flows out from the outlet end 69 of the first oil drainage passage 62 is not blown off by the gas in the low-pressure chamber 45 and does not accompany the gas to be sucked into a scroll-type compression mechanism C.

What is claimed is:

1. A closed-type scroll compressor, comprising:

a closed housing formed with a low-pressure chamber and a high-pressure chamber;

a scroll-type compression mechanism disposed in said low-pressure chamber and having a fixed scroll and a swirling scroll;

a frame to which said fixed scroll is fixed and which is provided with a first oil drainage passage;

a motor configured to drive said scroll-type compression mechanism and including a rotor and a stator provided with a second oil drainage passage;

a shaft to transmit a driving force of said motor to said scroll-type compression mechanism; and a connection oil drainage passage that is formed by a trough and an inner circumferential surface of said closed housing, an inlet end of the connection oil drainage passage covering an outlet end of said first oil drainage passage an outlet end of the connection oil drainage passage being located near an inlet end of said second oil drainage passage.

2. A closed-type scroll compressor, comprising:

a closed housing formed with a low-pressure chamber and a high-pressure chamber;

a scroll-type compression mechanism disposed in said low-pressure chamber and having a fixed scroll and a swirling scroll;

a frame to which said fixed scroll is fixed and which is provided with a first oil drainage passage;

a motor configured to drive said scroll-type compression mechanism and including a rotor and a stator provided with a second oil drainage passage;

a shaft to transmit a driving force of said motor to said scroll-type compression mechanism; and a connection oil drainage passage that is formed by a trough and an inner circumferential surface of said closed housing, an inlet end of the connection oil drainage passage covering only a circumferential part of an outlet end of said first oil drainage passage, an outlet end of the connection oil drainage passage being located near an inlet end of said second oil drainage passage.

3. A closed-type scroll compressor, comprising:

a closed housing formed with a low-pressure chamber and a high-pressure chamber;

a scroll-type compression mechanism disposed in said low-pressure chamber and having a fixed scroll and a swirling scroll;

a frame to which said fixed scroll is fixed and which is provided with a first oil drainage passage;

a motor configured to drive said scroll-type compression mechanism and including a rotor and a stator provided with a second oil drainage passage;

a shaft to transmit a driving force of said motor to said scroll-type compression mechanism; and a connection oil drainage passage that is formed by a trough and an inner circumferential surface of said closed housing, an inlet end of the connection oil drainage passage being located near an outlet end of said first oil drainage passage, an outlet end of the connection oil drainage passage being located in said second oil drainage passage.

4. A closed-type scroll compressor, comprising:

a closed housing formed with a low-pressure chamber and a high-pressure chamber;

a scroll-type compression mechanism disposed in said low-pressure chamber and having a fixed scroll and a swirling scroll;

a frame to which said fixed scroll is fixed and which is provided with a first oil drainage passage;

a motor configured to drive said scroll-type compression mechanism and including a rotor and a stator provided with a second oil drainage passage;

a shaft to transmit a driving force of said motor to said scroll-type compression mechanism; and a connection oil drainage passage that is formed by a trough and an inner circumferential surface of said closed housing a connection drainage inlet end of the connection oil drainage passage being located near a first drainage outlet end of said first oil drainage passage to form an aperture between the connection drainage inlet end and the first drainage outlet end, a connection drainage outlet end of the connection oil drainage passage being located near a second drainage inlet end of said second oil drainage passage to form an aperture between the connection drainage outlet end and the second drainage inlet end.

* * * * *